US005938390A

United States Patent [19]

Jordan

[11] Patent Number: 5,938,390

[45] Date of Patent: Aug. 17, 1999

[54] ANTIFRACTURE SCORES FOR EASY OPEN CONTAINER WALLS

[75] Inventor: Charles L. Jordan, New Kensington, Pa.

[73] Assignee: Aluminum Company of America, Pittsburgh, Pa.

[21] Appl. No.: 08/990,951

[22] Filed: Dec. 15, 1997

[51] Int. Cl.[6] ..... B21D 51/44

[52] U.S. Cl. ..... 413/12; 413/17; 413/67

[58] Field of Search ..... 413/12, 67, 56, 413/17, 15; 220/266, 276, 270

[56] References Cited

U.S. PATENT DOCUMENTS

| | | | |
|---|---|---|---|
| 3,406,866 | 10/1968 | Jasper | 220/54 |
| 3,426,714 | 2/1969 | Bolk et al. | 413/12 |
| 3,688,718 | 9/1972 | Schrecker . | |
| 3,728,980 | 4/1973 | Fraze . | |
| 3,735,894 | 5/1973 | Kinkel | 220/54 |
| 3,747,797 | 7/1973 | Gayner et al. | 220/53 |
| 3,902,626 | 9/1975 | Jordan et al. | 220/266 X |
| 3,954,075 | 5/1976 | Jordan | 220/266 X |
| 3,968,899 | 7/1976 | Jordan | 220/266 |
| 4,043,481 | 8/1977 | Herbst | 220/266 |
| 4,122,791 | 10/1978 | Brown . | |
| 4,149,479 | 4/1979 | Zundel . | |
| 4,216,736 | 8/1980 | Westphal . | |
| 4,254,890 | 3/1981 | Westphal | 220/276 |
| 4,348,464 | 9/1982 | Khoury | 428/571 |
| 4,504,181 | 3/1985 | Khoury | 413/17 |
| 5,373,721 | 12/1994 | Welsh et al. | 413/12 X |
| 5,738,237 | 4/1998 | McEldowney | 413/17 X |

FOREIGN PATENT DOCUMENTS

| | | | |
|---|---|---|---|
| 0199535 | 12/1982 | Japan | 413/17 |
| 1164179 | 9/1969 | United Kingdom . | |

*Primary Examiner*—James F. Coan

*Attorney, Agent, or Firm*—David W. Brownlee; Edward L. Levine

[57] ABSTRACT

An improved method and apparatus for scoring a metallic container wall, which facilitates scoring thin gauge, hard temper metal such as coated or uncoated aluminum to reduced score residuals wherein the scoring tool has a secondary antifracture score indenter on one or both sides of a primary indenter and in which the outboard secondary indenter has an outboard face angled about 30 to 40 degrees to vertical.

12 Claims, 3 Drawing Sheets

758010 - uF Primary Score $H_3PO_4$ 250X

758010 - uF DD Score $H_3PO_4$ 50X

ANTIFRACTURE SCORES FOR EASY OPEN CONTAINER WALLS

BACKGROUND OF THE INVENTION

1. Field of the Invention

This invention relates to the manufacture of easy open container closures and can end walls and in particular to an improved method and apparatus for scoring metallic container walls.

2. Description of the Prior Art

It is well known to provide a container wall or end closure having a removable or partially removable panel portion which is defined or outlined by a primary score line. The typical end closure has a pull tab attached to the removable panel to rupture the score line and at least partially separate the panel from the end closure. The removable panel may provide a pour opening for beer, beverage or other liquid contents or may be relatively large such as a full panel pull out for food, soup or other solid or semi-solid contents.

It is also well known to provide a secondary score line of lesser depth than the primary score line. This score line, commonly referred to as an "antifracture score" is provided to reduce residual stresses associated with the primary score line so as to prevent or minimize the occurrence of microcracks in or premature fracture along the primary score line. This concept is described in several patents including British Patent 1,164,179 and U.S. Pat. Nos. 3,406,866, 3,735,894 and 3,954,075. The invention disclosed in U.S. Pat. No. 3,954,075 was made by Charles L. Jordan, who is the sole inventor of the present invention.

The disclosure of U.S. Pat. No. 3,954,075 is incorporated herein by reference. That patent illustrates and describes a container wall having a primary score around a removable or partially removable panel or sector and further having a secondary antifracture score on one or both sides of the primary antifracture score. The primary score penetrates the container wall to about one-half its total penetration before the antifracture scores begin to penetrate the metal. That patent states that it is believed that the use of the antifracture score indenters will be beneficial in scoring any bare or unlayered, laminated, layered or coated metal container wall wherein a layer or layers of a material may have different flow characteristics than the metal being scored. It further states that it is believed that application of the compressive force, such as by a secondary indenter, will greatly reduce or obviate tendencies of nonuniform metal flows. The invention of U.S. Pat. No. 3,954,075 was further aimed at facilitating thinner score residuals without cracking of the metal in the primary score line. Thinner score residuals are desirable to reduce the force required to pop and pull the pull tab during opening of an easy open container wall.

In the twenty plus years since the invention of my U.S. Pat. No. 3,954,075, harder temper metals and thinner gauge container sheet have been developed. New laminated and coated container sheet materials have also been developed for use in easy open container walls. End wall designs have also been developed which call for thinner residuals in the primary score line to minimize the force required to initiate rupture and sever the score lines.

Despite the continued mass production of easy open container walls, and the development of higher strength container sheet and coatings/laminates for such uses, the double antifracture score invention of my U.S. Pat. No. 3,954,075 has been utilized in only limited commercial production. The beneficial objectives of that invention have not been realized in commercial production despite the long-standing needs for achieving such objectives. Although the reason for the lack of commercial use of the invention covered by U.S. Pat. No. 3,954,075 is not understood, it is believed that manufacturers of easy open container walls may have experienced problems with failure of the outboard antifracture indenter and/or unsatisfactory reduction of stress corrosion cracking of the metal and/or coatings in the primary score.

There is a need for an improved method and apparatus for scoring metallic container walls to facilitate commercial use of double antifracture scores to minimize or eliminate microcracks of the metal in the primary score line or in a protective coating or layer of organic materials on the underside ("product side") of easy open container walls.

SUMMARY OF THE INVENTION

This invention facilitates scoring of metal container walls to a thinner score residual without producing unacceptable cracking in the primary score or unacceptable degradation of coatings on the product side of the container wall. The method of this invention puts the metal in the score line in compression during scoring by employing improved antifracture score indenters on the scoring tool. Scoring tools of this invention are more robust and have longer tool life than do conventional scoring tools.

This invention provides an improved method and apparatus for scoring easy open container walls using a scoring tool having a secondary score indenter on at least the outboard side of the primary score indenter, and preferably on both the outboard and inboard sides of the primary score indenter. The secondary indenter or indenters are generally frustoconical in cross-section except that the side surface facing away from the primary indenter is less sharply inclined than is the surface that faces the primary indenter. In most other respects the method and apparatus of this invention are the same or similar to the method and apparatus described and illustrated in my U.S. Pat. No. 3,954,075. In the present invention the outboard face of the outboard secondary indenter has an angle of about 30 to 40° to vertical, and preferably at an angle of about 35° to vertical. The inboard face of the outboard secondary indenter has an angle of less than about 30° to vertical, and preferably an angle of about 25° to vertical. The inboard secondary indenter is just the opposite of the outboard secondary indenter and has its inboard face inclined at about 30–40° (and preferably about 35°) to vertical and its outboard face inclined less than about 30° (and preferably about 25°) to vertical.

This invention also encompasses scored container walls produced by the method and apparatus of this invention.

It is an object of this invention to provide an improved method and apparatus for scoring easy open container walls without failure of the secondary score indenters.

It is another object of this invention to provide a method for scoring container walls to have a thinner score residual and thereby facilitate opening of the containers, especially the large opening beverage ends which are popular in the market today.

It is a further object of this invention to provide a method and apparatus for scoring an easy open container wall made of coated or uncoated, hard temper, thin gauge metal container sheet with essentially no microcracks in the metal in the primary score or the coating on the product side of the container wall under the primary score.

The above and other objects and advantages of this invention will be more fully understood and appreciated by reference to the detailed description and drawings appended hereto.

DESCRIPTION OF THE PREFERRED EMBODIMENTS

Figure 1:
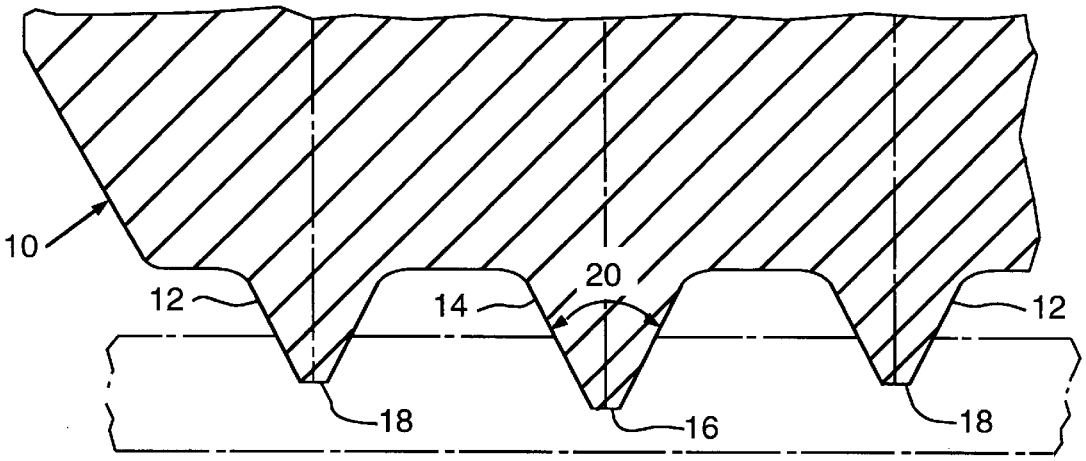
FIG. 1 Prior Art
FIG. 1 is a schematic vertical section of a scoring tool configuration of U.S. Pat. No. 3,954,075 (prior art).

FIG. 1 illustrates a score tool 10 of U.S. Pat. No. 3,954,075. The tool 10 has two antifracture score indenters 12 on either side of a primary indenter 14. The primary indenter has an included angle 20 between its sidewalls of about 50° to 60° and an end face width 16 of about 0.0025 inch to 0.0030 inch. Each of the secondary indenters 12 has a face 18 of about 0.0025 inch to 0.0030 inch. U.S. Pat. No. 3,954,075 describes, in Example 1, that all three indenters 12 and 14 have included angles of about 50° between their side walls. The two antifracture score indenters 12 are spaced approximately 0.025 inch (centerline to centerline) from the primary indenter 14.

Figure 2:
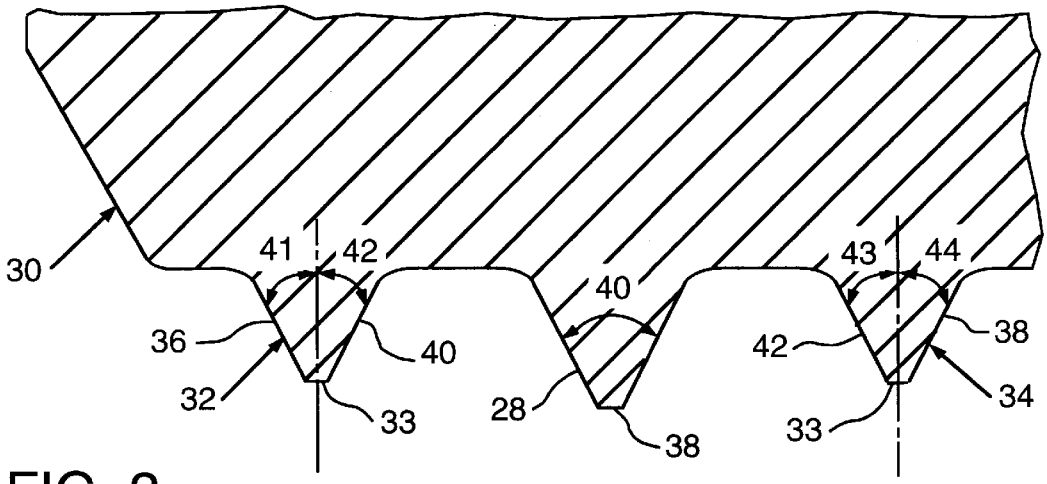
FIG. 2 is a schematic vertical section of a scoring tool configuration of this invention.

FIG. 2 illustrates a score tool 30 of the present invention, which is similar to the score tool 10 of U.S. Pat. No. 3,954,075. Score tool 30 has two antifracture indenters 32 and 34, one on either side of a primary indenter 28. The primary indenter has an included angle 40 between its sidewalls or side faces or surfaces of about 50° to 60° and an end face 38 of about 0.0005 inch to 0.0020 inch in width, and preferably about 0.0010–0.0015 inch in width. The antifracture indenters 32 and 34 are each preferably spaced approximately 0.025 inch (centerline to centerline) from the primary indenter 28, and each has an end face 33 having a width in a range of about 0.0015 to 0.0030 inch, and preferably about 0.0025 inch. Depending on the thickness of the metal in the container wall to be scored, the primary indenter 28 may project downwardly approximately 0.0015 to 0.0020 inch further than the secondary indenters 32, 34.

Figure 3:
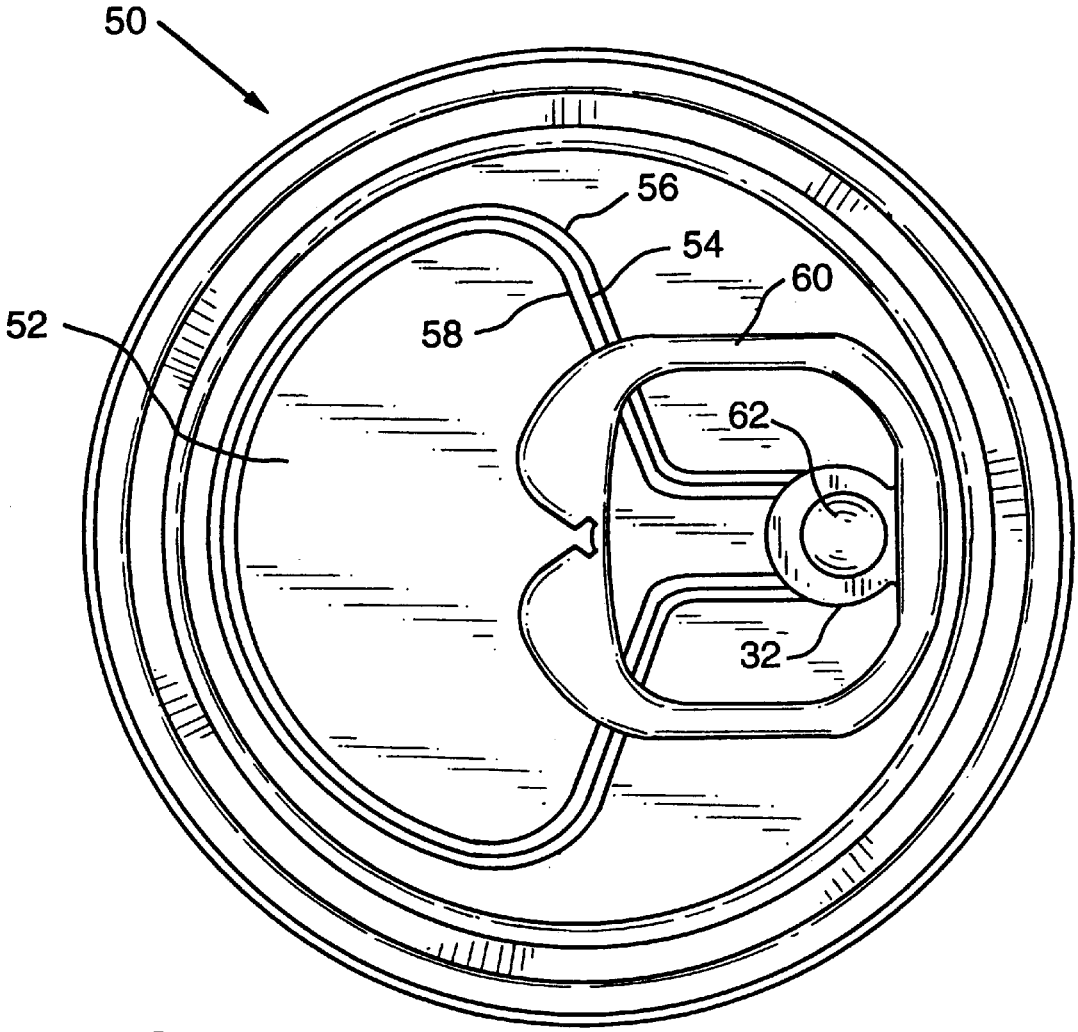
FIG. 3 is a top plan view of an easy open container wall having antifracture scores of this invention provided therein.

The score tool 30 is designed to score an easy open container wall having a removable panel such as, for example, the container wall 50 illustrated in FIG. 3 which has a removable panel 52 defined by a primary score 54. The container wall 50 further has secondary antifracture scores 56 and 58 on either side of the primary score. The secondary score 56 is on the outboard side of the primary score 54, and the secondary score 58 is on the inboard side of the primary score. The secondary scores extend for substantially the full length of the primary score and are preferably parallel to one another and to the primary score. A pull tab 60 is attached to the removable panel 52 through an integral rivet 62. The pull tab 60 is lifted and pulled to pop the primary score line and separate the panel 52 from the container wall.

Referring back to FIG. 2, the secondary score indenter 32 on the left side of the primary indenter is herein referred to as the outboard indenter for scoring the outboard secondary score such as score 56 in FIG. 3, and indenter 34 on the right side of the primary indenter is referred to as the inboard indenter for scoring the inboard score such as score 58 in FIG. 3.

It is an important feature of this invention that each of the secondary indenters 32 and 34 is non-symmetrical in cross-section and that the outboard face 36 of the outboard indenter 32 and the inboard face 38 of the inboard indenter 34 are less sharply inclined or less vertical than are the opposite faces 40, 42 of such indenter. More specifically, the outboard face 36 of the outboard indenter 32 and the inboard face 38 of the inboard indenter 34 are each preferably inclined approximately 30–40° to vertical and more preferably about 35° to vertical. The opposite faces 40 and 42 of indenters 32 and 34 adjacent the primary indenter 28 are preferably inclined less than about 20–30° to vertical, and more preferably about 20–25° to vertical. Although not yet tested, it is believed that the faces 40 and 42 may best be only slightly inclined to vertical such as about 5–10°. The best angle of inclination of the faces of the indenters 32 and 34 will depend on a number of factors such as the thickness, composition and properties of the metal in the container wall being scored, the design of the container wall, the depth of the scores, whether the metal is coated or uncoated, and the use to be made of the container wall. It is also believed that providing a small radius on the bottom corners on the secondary indenters 32 and 34 should enhance performance of the tool 30. However, forming such a radius on the corners would be difficult and may not be practical.

Figure 4:
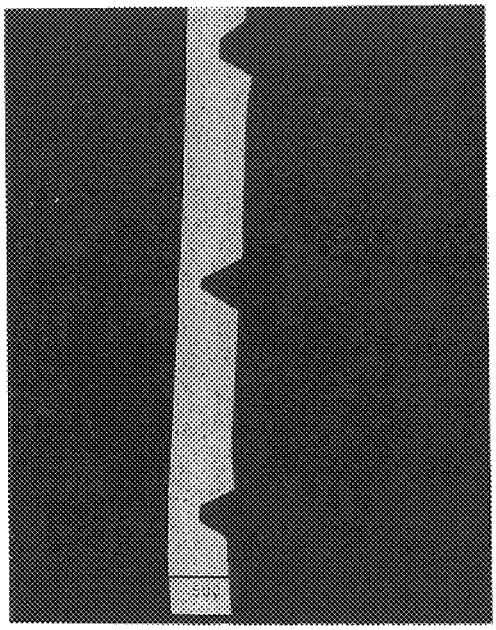
FIG. 4 is a photomicrograph of a vertical section through a primary score and the double antifracture scores in an easy open container wall having antifracture secondary scores formed in it in accordance with this invention.

FIG. 4 is a photomicrograph through the primary and double antifracture scores in a container wall of this invention. This photomicrograph shows the thicker metal between the primary score and the antifracture scores as compared to the metal outboard and inboard of the two antifracture scores. This conclusively established that the antifracture indenters, in combination with the primary indenter, puts the metal into compression during scoring. That compression is what causes the metal to thicken. Forming the metal under compression eliminates or at least reduces fractures in the primary score line. Tension in the metal in a container wall underlying the base or bottom of the score tool during scoring is what is believed to cause score line cracking with conventional tools.

Figure 5:
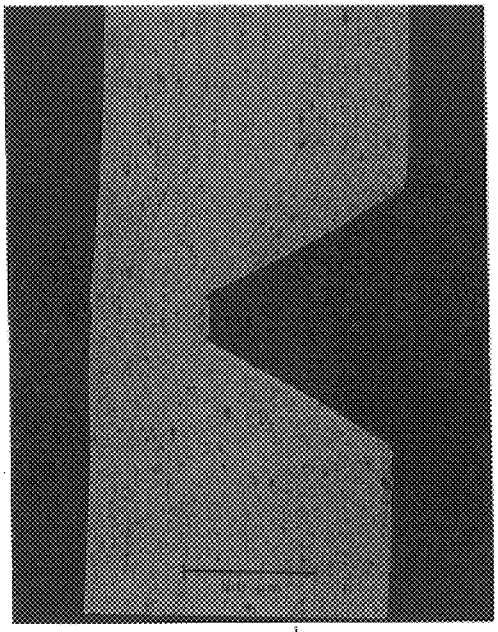
FIG. 5 is a photomicrograph of an enlarged section through the primary score shown in FIG. 4.

FIG. 5 is an enlarged photomicrograph through a primary score in a container wall that has been scored in accordance with this invention. The metal flow is uniform and symmetric about the primary score and no microcracks are present in the metal. The slip planes of the metal are symmetrical on both sides of the score and no deformation bands or fissure is visible in the metal at the base of the score. Stress corrosion tends to follow slip bands or fissures.

It is therefore seen that the double antifracture scores of this invention are useful in producing improved easy open container walls having fewer microcracks in the metal in the score line and/or degradation of coating on the product side of the container wall under the score line. This invention provides an improved, more robust tool and method that substantially improves tool life over the tools disclosed in my prior U.S. Pat. No. 3,954,075. This invention provides a method of scoring container walls to a thinner score residual than has been possible with prior methods without causing unacceptable cracking of metal in the score residual or unacceptable degradation of the interior coating on the container wall. Thinner score residuals are desirable to provide improved operability of easy opening end walls. Preliminary testing of this invention also indicates that easy opening container walls produced by the improved tools of this invention have reduced stress corrosion cracking.

Whereas particular embodiments of this invention have been described for purposes of illustration, it will be evident to those skilled in the art that numerous variations in details may be made without departing from the invention as described in the appended claims.

I claim:

1. In a method of scoring a metallic container wall to provide a removable sector in which a secondary indenter applies a compressive pressure outboard of and substantially coextensive with a primary indenter to form an antifracture indentation before the primary indenter has penetrated to about 50% of its ultimate penetration, the improvement comprising forming said antifracture indentation with a secondary indenter having an outboard face angled to vertical in a range of about 30 to 40°, an inboard face which is angled to vertical in a range of about 20 to 30°, and said outboard face has an angle to vertical which is about 10–20° greater than the angle to vertical of said inboard face.

2. A method as set forth in claim 1 in which a compressive pressure is applied by secondary indenters on both sides of and substantially coextensive with said primary indenter.

3. A method as set forth in claim 1 in which said outboard face of the secondary indenter is angled about 35° to vertical.

4. A method as set forth in claim 1 in which said metallic container is made from hard temper aluminum container sheet having an organic layer of protective material on the face thereof opposite the face in which said indentation is formed.

5. A method as set forth in claim 1 in which said secondary indenter is applied against said metallic container wall when said primary indenter has penetrated said wall approximately 0.0015 to 0.0025 inch.

6. A method as set forth in claim 1 in which the centerline of said secondary indenter is spaced from said primary indenter approximately 0.025 to 0.035 inch.

7. A method as set forth in claim 2 in which said secondary indenter on the inboard side of said primary indenter has an inboard face which is angled to vertical in a range of about 30 to 40°.

8. An apparatus for scoring a metallic container wall to provide a removable sector with a tool having a primary indenter and a secondary indenter outboard and substantially coextensive with said primary indenter to form a primary score and a secondary score, said primary indenter projecting approximately 0.0015 to 0.0025 inch further than said secondary indenter to begin penetration of a metallic container wall before said secondary indenter begins to penetrate said wall, the improvement wherein said secondary indenter has an included angle of about 50–70° between its inboard and outboard faces, said outboard face is angled about 30–40° to vertical and outboard face has an angle to vertical which is about 10–20° greater than the angle of said inboard face to vertical.

9. Apparatus as set forth in claim 8 wherein said tool has a secondary indenter on both sides of said primary indenter.

10. Apparatus as set forth in claim 9 in which the centerline of said secondary indenters are spaced about 0.025 to 0.055 inch on opposite sides of said primary indenter.

11. Apparatus for scoring a metallic container wall to provide a removable sector comprising a tool having a primary indenter and two frustoconical secondary indenters with one of said secondary indenters on each side of said primary indenter, and the centerline of each secondary indenter is spaced about 0.025 to 0.035 inch from the centerline of said primary indenter, said secondary indenters each having inboard and outboard faces with an included angle of about 50–70° between them with the outboard face of said outboard indenter and the inboard face of said inboard indenter inclined to vertical at an angle in a range of about 30 to 40°, and said outboard face of said outboard indenter has an angle to vertical which is about 10–20° greater than the angle to vertical of said inboard face of said outboard indenter.

12. Apparatus as set forth in claim 11 in which said inboard face of said inboard indenter has an angle to vertical which is about 10–20° greater than the angle to vertical of said outboard face of said inboard indenter.

* * * * *